US009060636B2

(12) United States Patent
Cannaverde

(10) Patent No.: US 9,060,636 B2
(45) Date of Patent: Jun. 23, 2015

(54) MODULAR BRACKET SYSTEM FOR WINDOW TREATMENT

(71) Applicant: Rollease, Inc., Stamford, CT (US)

(72) Inventor: Joseph Cannaverde, Stamford, CT (US)

(73) Assignee: Rollease, Inc., Stamford, CT (US)

( * ) Notice: Subject to any disclaimer, the term of this patent is extended or adjusted under 35 U.S.C. 154(b) by 0 days.

(21) Appl. No.: 13/962,042

(22) Filed: Aug. 8, 2013

(65) Prior Publication Data

US 2013/0319624 A1 Dec. 5, 2013

Related U.S. Application Data

(63) Continuation of application No. 13/228,764, filed on Sep. 9, 2011.

(60) Provisional application No. 61/426,584, filed on Dec. 23, 2010.

(51) Int. Cl.

| | |
|---|---|
| ***E06B 9/50*** | (2006.01) |
| ***A47H 1/03*** | (2006.01) |
| ***E06B 9/174*** | (2006.01) |
| *E06B 9/24* | (2006.01) |

(52) U.S. Cl.

CPC ... *A47H 1/03* (2013.01); *E06B 9/50* (2013.01); *E06B 9/174* (2013.01); *E06B 2009/2447* (2013.01)

(58) Field of Classification Search

USPC ..... 160/323.1, 903; 248/256, 268, 220.41, 248/220.42, 220.43

IPC ..... E06B 9/50,9/42, 9/323; A47H 1/13

See application file for complete search history.

(56) References Cited

U.S. PATENT DOCUMENTS

| | | | | | |
|---|---|---|---|---|---|
| 899,116 | A | | 9/1908 | Smith | |
| 931,968 | A | | 8/1909 | Loughner | |
| 1,329,249 | A | | 1/1920 | Leach | |
| 1,476,160 | A | | 12/1923 | Kirsch | |
| 1,545,160 | A | | 7/1925 | Myers | |
| 1,604,157 | A | * | 10/1926 | Fields | 248/256 |
| 1,678,590 | A | | 7/1928 | Dixson | |
| 1,744,682 | A | * | 1/1930 | Cordsen | 160/307 |
| 2,001,864 | A | | 5/1935 | Benjinsohn | |
| 2,056,111 | A | * | 9/1936 | O'Connor | 248/271 |
| 2,099,068 | A | | 11/1937 | Keithly | |
| 2,138,502 | A | | 11/1938 | Nordstrom, Jr. | |
| 2,238,196 | A | * | 4/1941 | Tyler | 248/267 |
| 2,548,041 | A | | 4/1951 | Morse | |
| 2,594,656 | A | | 4/1952 | Junkung | |
| 2,792,999 | A | * | 5/1957 | Lorentzen | 248/264 |
| 2,974,918 | A | * | 3/1961 | Voigtlander | 248/201 |
| 3,136,357 | A | | 6/1964 | Lorentzen et al. | |
| 3,196,935 | A | | 7/1965 | Cristensen | |

(Continued)

*Primary Examiner* — David Purol

(74) *Attorney, Agent, or Firm* — Gottlieb, Rackman & Reisman, P.C.

(57) ABSTRACT

A bracket system for window dressing includes two brackets configured to be attached to an architectural member, such as a window well, a wall or a ceiling and receive the ends of window dressings. The brackets have edges adapted to receive a fascia designed to hide the window dressing. Preferably, the fascia has a front wall designed to snap onto the brackets and is sized so that it extends above the brackets to provide a neater and cleaner look. The fascia may be L-shaped with a vertical and a horizontal member and the brackets may be configured so that the horizontal member attaches either to the top or to the bottom of the brackets.

9 Claims, 15 Drawing Sheets

(56) References Cited

U.S. PATENT DOCUMENTS

| | | | | | |
|---|---|---|---|---|---|
| 3,372,728 | A | * | 3/1968 | Schaefer | 160/39 |
| 3,595,511 | A | * | 7/1971 | Summerville, Jr. | 248/264 |
| 3,734,440 | A | * | 5/1973 | Hoare | 248/265 |
| 3,854,517 | A | | 12/1974 | Nakamura | |
| 4,114,233 | A | | 9/1978 | Hamilton | |
| 4,122,559 | A | | 10/1978 | Kelly | |
| 4,167,261 | A | | 9/1979 | Bartels | |
| 4,231,411 | A | | 11/1980 | Hehl et al. | |
| 4,249,714 | A | | 2/1981 | Boyle | |
| 4,372,432 | A | | 2/1983 | Waine et al. | |
| 4,399,855 | A | | 8/1983 | Volfson | |
| 4,433,765 | A | | 2/1984 | Rude et al. | |
| 4,466,475 | A | | 8/1984 | Saito et al. | |
| 4,538,785 | A | * | 9/1985 | Damsgaard | 248/268 |
| 4,623,012 | A | | 11/1986 | Rude et al. | |
| 4,729,418 | A | | 3/1988 | Rude | |
| 4,750,539 | A | * | 6/1988 | Chang | 160/176.1 V |
| 4,751,953 | A | | 6/1988 | Appel et al. | |
| 4,828,002 | A | * | 5/1989 | Ashby | 160/38 |
| 4,865,109 | A | | 9/1989 | Sherman | |
| 5,029,629 | A | | 7/1991 | Cheng-Pei | |
| 5,330,821 | A | | 7/1994 | Lo | |
| 5,609,196 | A | | 3/1997 | Kraler | |
| 5,857,653 | A | | 1/1999 | Dujlovich | |
| D409,079 | S | | 5/1999 | Sobczynski | |
| D409,474 | S | | 5/1999 | Chou | |
| 5,975,186 | A | | 11/1999 | Day | |
| 6,164,428 | A | | 12/2000 | Berman et al. | |
| 6,173,825 | B1 | | 1/2001 | Liu | |
| 6,196,508 | B1 | | 3/2001 | Nijs | |
| 6,202,967 | B1 | | 3/2001 | Fraczek | |
| 6,382,296 | B1 | | 5/2002 | Judkins | |
| 6,457,688 | B1 | | 10/2002 | Welfonder | |
| 6,499,709 | B1 | | 12/2002 | Parent | |
| 6,532,109 | B1 | | 3/2003 | Shopp | |
| 6,540,004 | B2 | * | 4/2003 | Wu | 160/321 |
| 6,585,208 | B1 | | 7/2003 | Fraser | |
| 6,739,373 | B1 | | 5/2004 | Liu et al. | |
| 6,817,402 | B1 | | 11/2004 | Fraczek et al. | |
| 6,935,401 | B2 | | 8/2005 | Fraczek et al. | |
| 6,981,539 | B2 | | 1/2006 | Fraczek | |
| D557,115 | S | | 12/2007 | Zakowski | |
| D557,116 | S | | 12/2007 | Zakowski | |
| D557,117 | S | | 12/2007 | Cannaverde | |
| 2003/0015301 | A1 | | 1/2003 | Killo | |

* cited by examiner

MODULAR BRACKET SYSTEM FOR WINDOW TREATMENT

RELATED APPLICATIONS

This application claims priority to U.S. Provisional application S.N. 61/1426,584 filed Dec. 23, 2010 and incorporated herein in its entirety and is a continuation of U.S. application Ser. No. 13/228,764 filed Sep. 9, 2011, now abandoned.

BACKGROUND OF THE INVENTION

A. Field of Invention

This invention pertains to a bracket system for window treatments configured and structured to accept and support several window shades and other types of treatments.

B. Description of the Prior Art

Most window treatments consist of an elongated member that supports one or more decorative elements to cover a window, a door, some other openings, or purely for decorative purposes. Controls are added that are normally at least partially in, or attached to the elongated member and used to selectively , open or close the treatment and/or perform various other operations thereon.

The elongated member is mounted either within the opening or on a vertical wall just adjacent to the opening using various types of brackets. FIG. 1 shows an end view of a conventional elongated member having an end bracket 10 with a conventional L-shaped fascia 12 disposed between the end brackets (such as 10) and arranged to protect and hide various interior elements of the window treatment. The bracket 10 is formed with a plurality of holes 14 for mounting the bracket. The fascia 12 is made from a sheet of metal, plastic or other relatively light but strong material.

The bracket 10 holds a clutch mechanism 16 operated by a chain cord 20 having ends 20A, 20B. The clutch mechanism 16 includes a pulley 18 operated by a chain chord 20 having cord ends 20A, 20B pulling on one end 20A or the other 20B causes the pulley to rotate in one direction or another thereby performing a predetermined function for the window treatment.

The fascia is made with a thin lip 22 bent inwardly. The bracket 10 is made with a corner opening 24 having at its front edge a tongue 26 sized and shaped to fit into the lip 22. The fascia 12 has a generally L-shaped cross-section with a major portion 30 terminating with lip 22 and a minor portion 32.

The window treatment is installed as follows. The bracket 10 and another similar bracket are mounted. The window treatment is mounted between the brackets. The fascia 12 is then positioned with its major portion being orientated essentially horizontally and the lip 22 is inserted into opening 24. The fascia 12 is then rotated around tongue 26 clockwise causing the minor portion 32 to come into contact with and snap unto bracket 10 reaching the position shown.

This arrangement has several disadvantages. First, a different-shaped bracket must be provided for each kind of window treatment. This can expensive and problematical for small distributors who cannot be fiscally burdened by requiring them to carry a large number of different types of brackets. Second, in some instances, the bracket must be mounted on horizontal wall W (using some other openings that have been omitted in FIG. 1). However, as can be seen in FIG. 1, tong 26 has to be disposed below the wall W by several millimeters to accommodate the fascia 12 and allow it to be secured to the bracket. As a result, the upper-most edge of the fascia 12 is always slightly below and not flush with the wall W. This feature is found objectionable by many persons because it leaves a very narrow gap between the fascia 12 and the wall W which allows some light to be seen above the fascia that is not pleasing esthetically.

Furthermore, existing brackets in general are sized and constructed to accommodate only window dressings of certain preselected configurations, and must be customized for each configuration.

SUMMARY OF THE INVENTION

The present invention addresses the problems discussed above and provides solutions to solve the problems. More specifically, a bracket system is provided that includes two brackets receiving ends of a window dressing. The brackets have a generally rectangular or square base with two side edges, a top edge and a bottom edge. Some of the edges are provided with panels disposed perpendicularly to the base.

The system further includes a fascia that is preferably L-shaped with a vertical member and a horizontal member. In one embodiment of the invention, the vertical member is mounted on the brackets so that a small portion of the fascia extends above the bracket thereby providing a neater look by blocking light from passing through above the fascia.

In another aspect of the invention, the panels or edges of the brackets are configured to accept the fascia in either a first configuration in which the horizontal part is on top of the brackets and a second configuration in which the fascia horizontal part is attached to the bottom of the brackets.

Plates may be mounted or attached to the brackets for accepting the ends of window shades. Adapters are attached to the plates, if necessary, various plates having different configurations to conform to or receive window dressings of different kinds. In some configuration, two or more parallel window dressings are supported by a single pair of brackets.

BRIEF DESCRIPTION OF THE DRAWINGS

FIG. 5A shows a side view of the facie for the bracket system;

FIG. 5B shows an elevational view of the bracket used in the system;

DETAILED DESCRIPTION OF THE INVENTION

Figure 1:
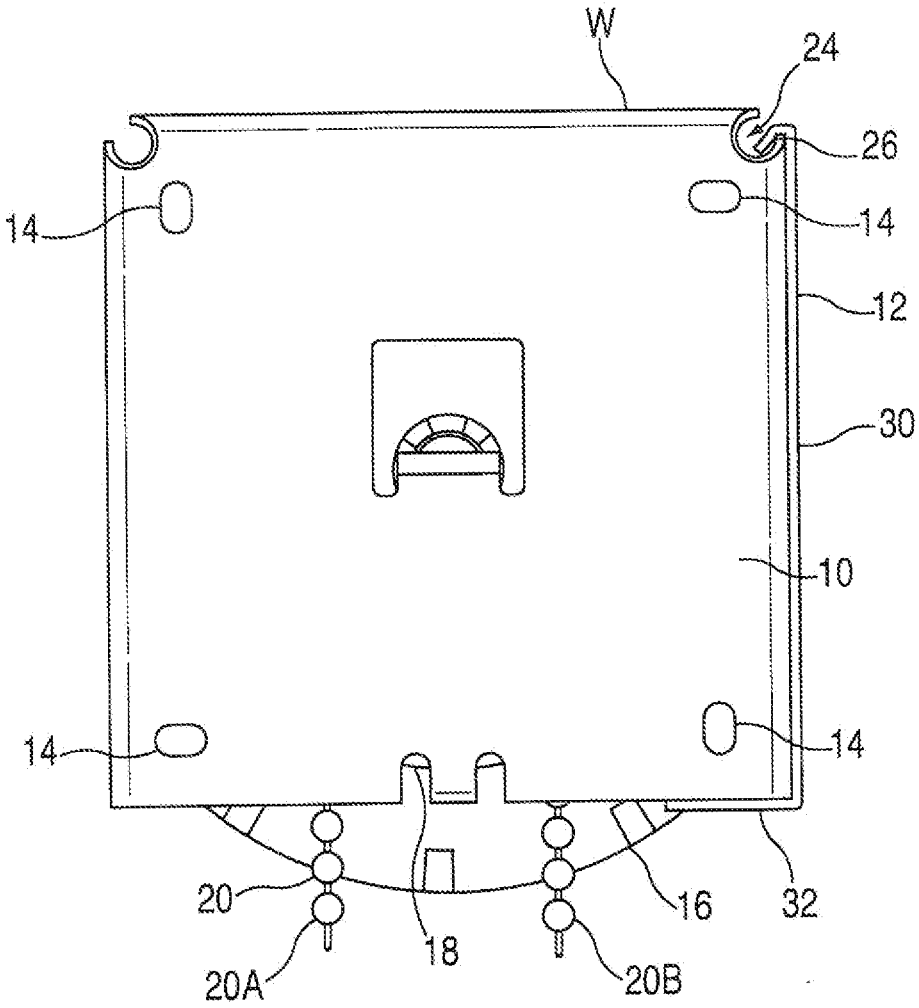
FIG. 1 (PRIOR ART)
FIG. 1 shows an end view of a prior art window dressing and its end bracket.
Figure 2:
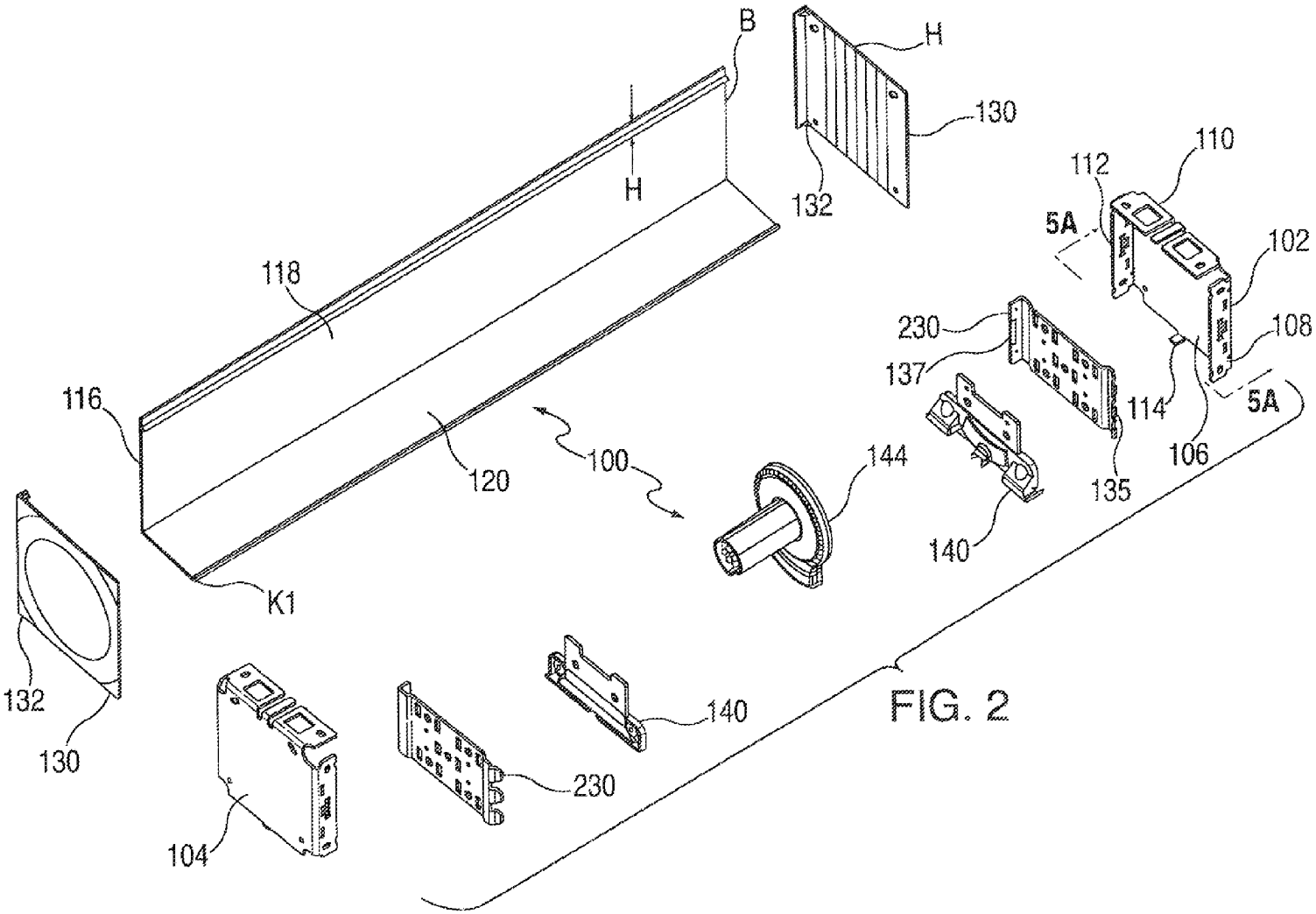
FIG. 2 shows an orthogonal exploded view of a bracket system for a window treatment constructed in accordance with this invention.

The major elements of bracket system constructed in accordance with this invention are shown in FIGS. 2-5B. The bracket system 100 includes two, preferably identical, end brackets 102, 104. The end brackets are 102, 104 preferably are made of a conventional metallic alloy using conventional techniques, such as stamping.

Each end bracket includes a flat rectangular base 106 and three panels 108, 110, 112 disposed along three sides of the base 106. The fourth side has a tab 114. The three panels and the tab are substantially perpendicular to the base 106. Panels 108, 110 are preferably identical and the panel 112 is configured so that it is symmetrical about a vertical axis of the brackets 102, 104. The three panels have a plurality of slots and perforations as described in more detail below.

Attached to the two brackets is a fascia 116. As shown in detail in FIG. 5A, the fascia 116 is L.-shaped and has two sections 118, 120. Section 118 is provided with an intermediate lip 122 shaped to form a channel 124. Section 120 is terminated with a lip 126 forming a channel 128. It should be understood that the dimensions of the lips 122 and 126 and channels 124 and 128 are somewhat exaggerated in FIG. 5A for the sake of clarity but in actuality there are shaped so that the channels are about the same cross-sectional width as the thickness of bracket 102 to form an interference therewith. The length of the fascia 116 is dependent on the width of the window dressing. Its total height HF is equal to H1+H2, where H1 is the distance from the free edge of section 118 to the lip 122. The fascia has a width W. The fascia 116 can be extruded aluminum or other similar material.

Figure 5A:
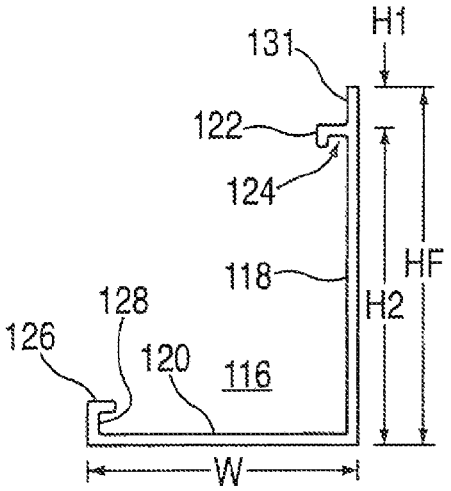
FIG. 5AA shows a side view of the plate.
Figure 5:
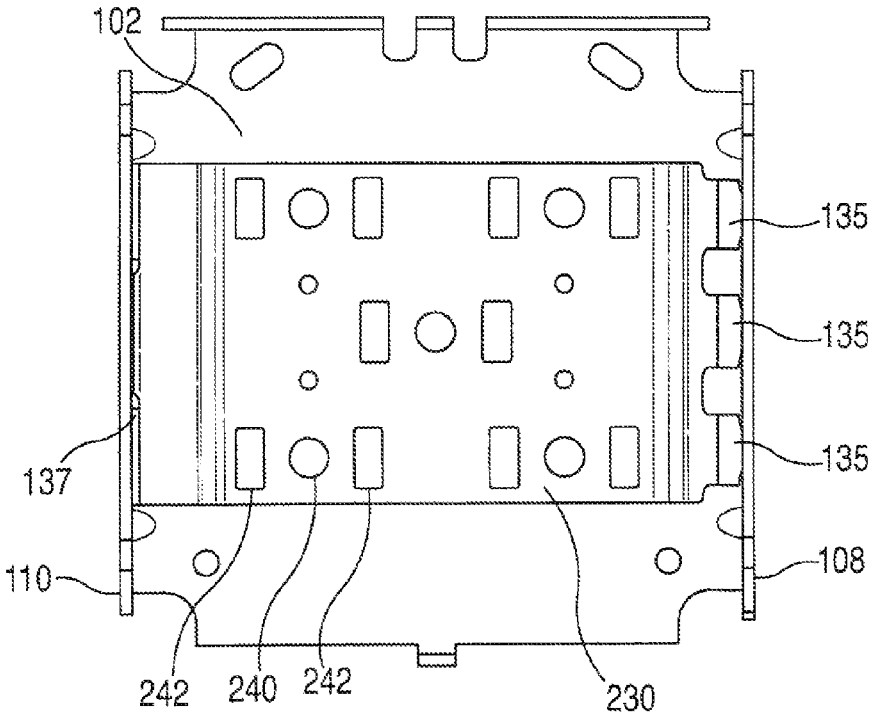
FIG. 5 shows an elevational view of a bracket with a plate.
Figure 5A:
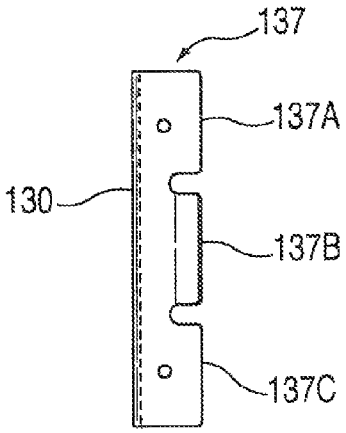
Figure 5B:
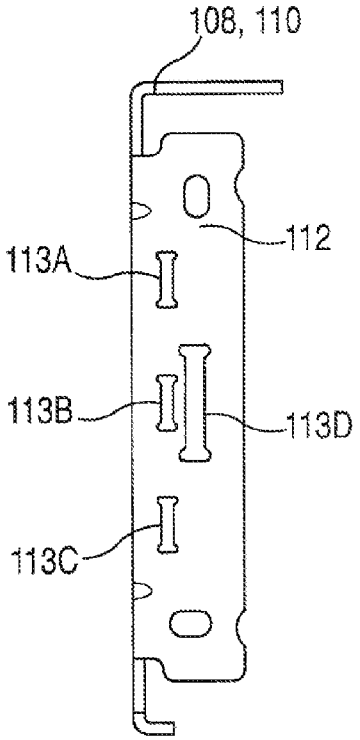
FIG. 5BB shows a side view of the bracket.
Figure 5B:
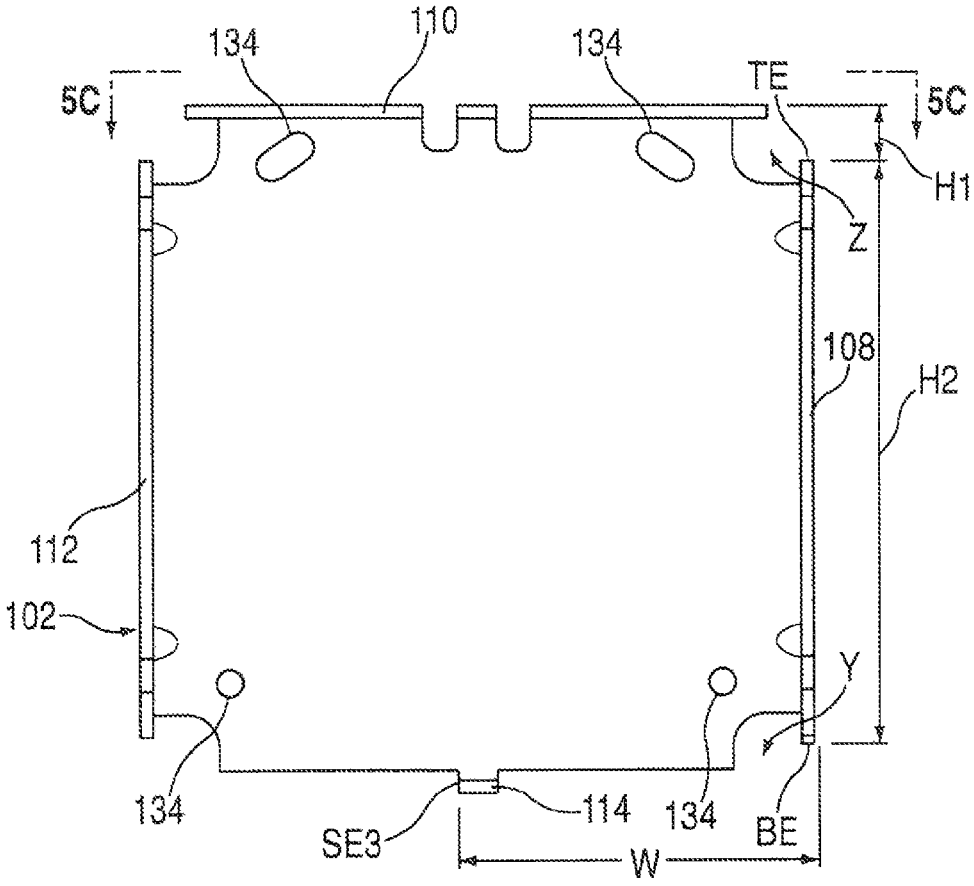
Figure 5C:
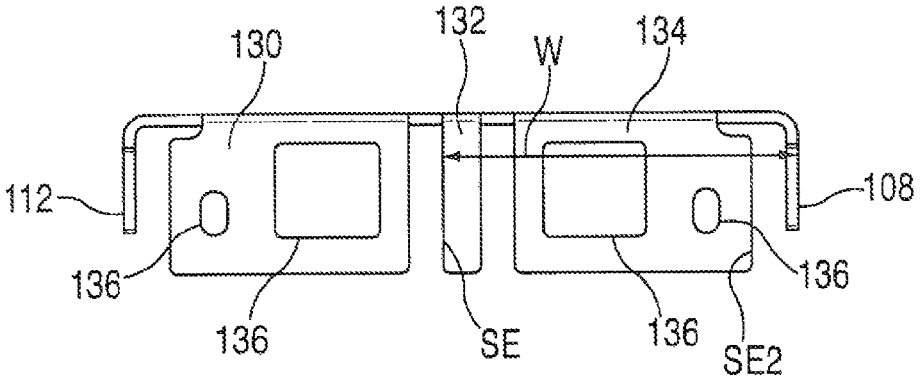
FIG. 5C shows top view of the bracket of FIG. 5B.

Details of the bracket 102 are shown in FIGS. 5A and 5B. Panel 110 is formed of three sections. Two of the sections 130, 134 are mirror images and include apertures 136 for mounting the brackets and to make the brackets lighter. The central section 132 has essentially the shape of an elongated tongue. Panel 110 has several dimensions that have special importance.

Figure 6:
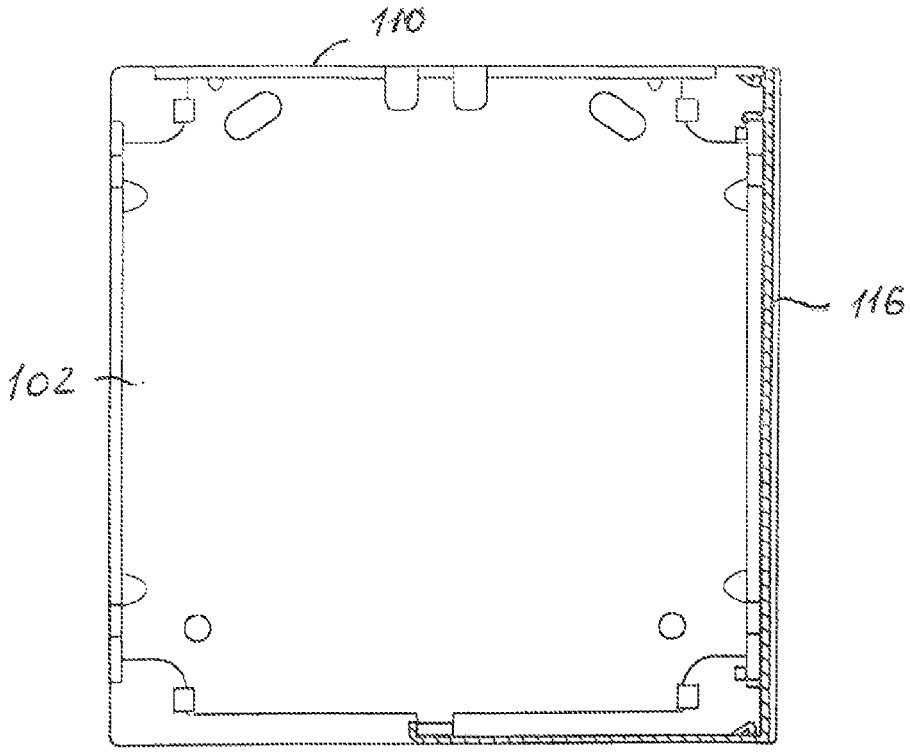
FIG. 6 shows a side sectional view of the fascia attached to a bracket.
Figure 7:
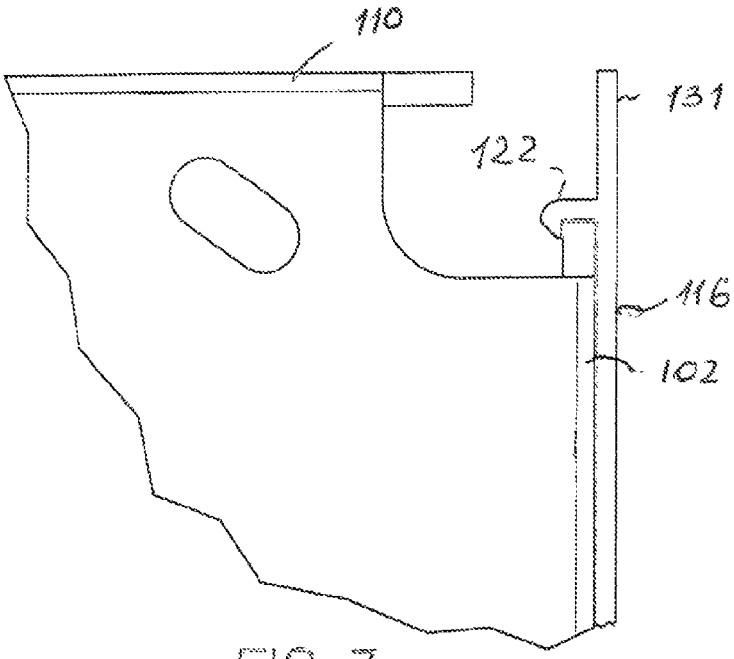
FIG. 7 shows an enlarged side view of the fascia attached to the bracket.

The distance between the side edge SE of section 132 and the outer surface of panel 108 is equally to the width W of fascia 116. The distance between side edge SE2 of section 134 and the outer surface of panel 108 is at least H1. The length of panel 108 is H2. The distance between the top edge TE of panel 102 and the outer surface of panel 110 is at least H1. The distance between the side edge SE3 of tab 114 and the outer surface of panel 108 is W. The distance between the bottom edge BE of panel 108 and the bottom surface of tab 114 is at least H1. As a result of these dimensions, the fascia 116 can be mounted on to the brackets 102, 104 in two configurations. In one configuration, the section 120 is attached to the bottom of the bracket as shown in FIG. 5A. In the second configuration, the section 120 is attached to the top of the bracket. In either case, the section 118 is attached to the panel 108 (or 112). Moreover, the portion 131 of section 118 extends vertically further then the panel 110 of bracket 102 by amount sufficient to insure that imperfections in the window seal or installing the bracket 102 slightly below the window seal does not result in a gap of light seen above the window dressing. For example, the portion 132 may exceed the top surface of section 110 by about 1/32-3/8". Moreover, the bracket and its panels are shaped so that fascia 116 is installed by first inserting its portion 131 into either zone Z or Y (see FIG. 58) and then pivoting it to snap onto the brackets 102, 104. The final position of the facie is shown in FIGS. 6 and 7.

In addition, the plate 230 also has on one side a plurality of tabs 135 and on the other side a panel 137. As seen in FIG. 5AA, the panel 137 is formed of three sections 137A, 137B, 137C. Each tab 135 is shaped so that it is angled slightly to permit the plates 230 to be press-fit into the brackets 102, 104 with the tabs 135 engaging the inner surfaces of slots 113A, 1138, 113C (these slots are shown in FIG. 5BB) of section 108. Both sections 108 and 110 further include a slot 113D which is somewhat longer then the slots just described. Section 137B is bent slightly outwardly and is sized and shaped to engage slot 113D on section 110. In other words, panel 137 and tabs 135 cooperate to maintain the plate 230 in place within the bracket 102, 104.

Figure 3:
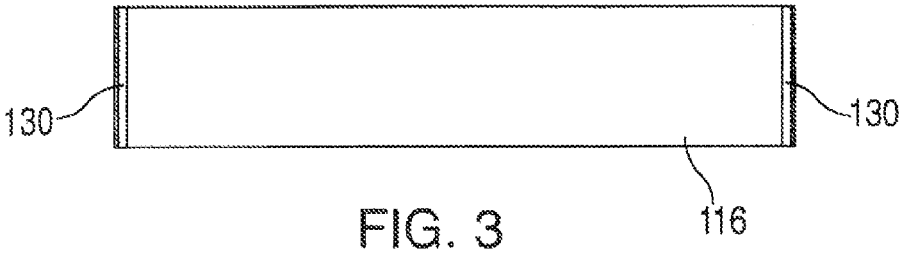
FIG. 3 shows a front view of the bracket system.
Figure 4:
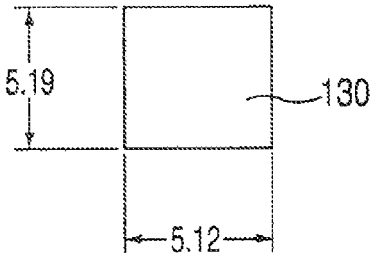
FIG. 4 shows an end view of the bracket system.

Completing the system, there are two end caps 130 (shown in detail in FIGS. 3 and 4). Each end cap may be sized to cover one of the brackets 102, 104 and serve mostly a decorative purpose. On their inner surface, caps 130 may be provided with fingers 132 (FIG. 2) that form an interference fit with holes 134 to mount and keep the end caps 130 on the brackets. Typically, end caps may be about 5.12×5.14 in and may be molded plastic or other materials.

The sizes specified herein is particularly useful for various configurations, such as one large shade, two or more smaller shades, a shade with a clutch, a shade with a wound spring or other mechanisms. Various plates, adapters, etc. are mounted (temporarily or permanently) on the brackets to accommodate various sizes, numbers and types of window shades. This modular design allows the bracket system to be used in a large variety of uses and applications. The remaining figures show some exemplary configurations for the bracket system illustrating just some of the configurations that may be used to support various window coverings.

Getting back to FIG. 5, bracket 102 is shown with a plate 230 formed with a set of five slots and holes arranged to receive the ends of respective window coverings, either directly, or via adapters.

Figure 8:
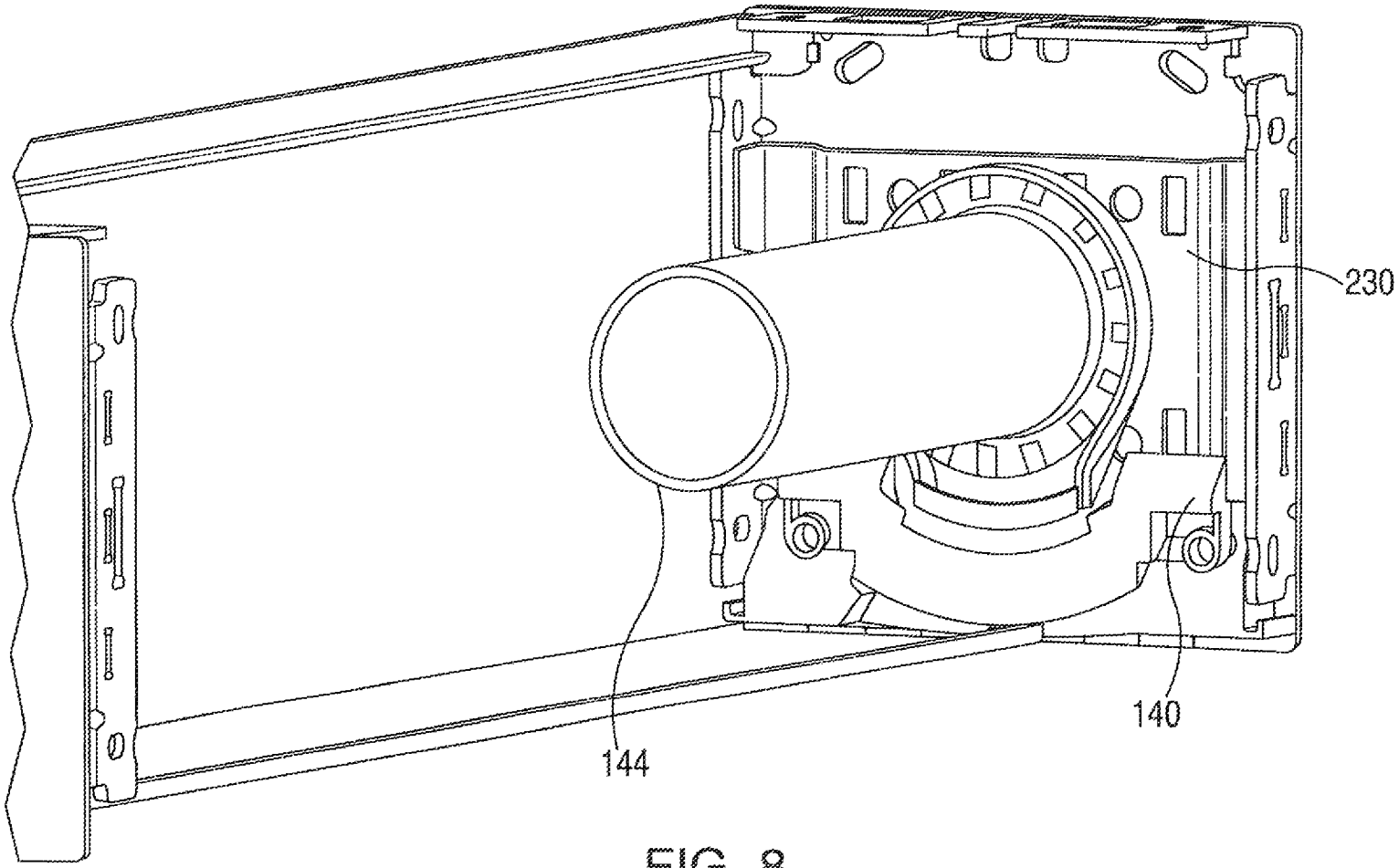
FIG. 8 shows an orthogonal view of a bracket of FIGS. 2-5 supporting some of the components of a window covering.

Each set includes a circular hole 240 and two rectangular slots 242 arranged on either side of the hole 240. This is a standard configuration and can be used to accept a window covering at each set of slots and holes. For example, in FIG. 5, adapters 140 are provided that mount on plates 230. The adapters are shaped and sized to receive and a standard clutch 144 at one end and a plain idler end (not shown) on the other bracket. FIG. 8 shows an enlarged isometric view of the bracket 104 with a plate 230, an adapter 140 and a clutch 144.

Figure 9:
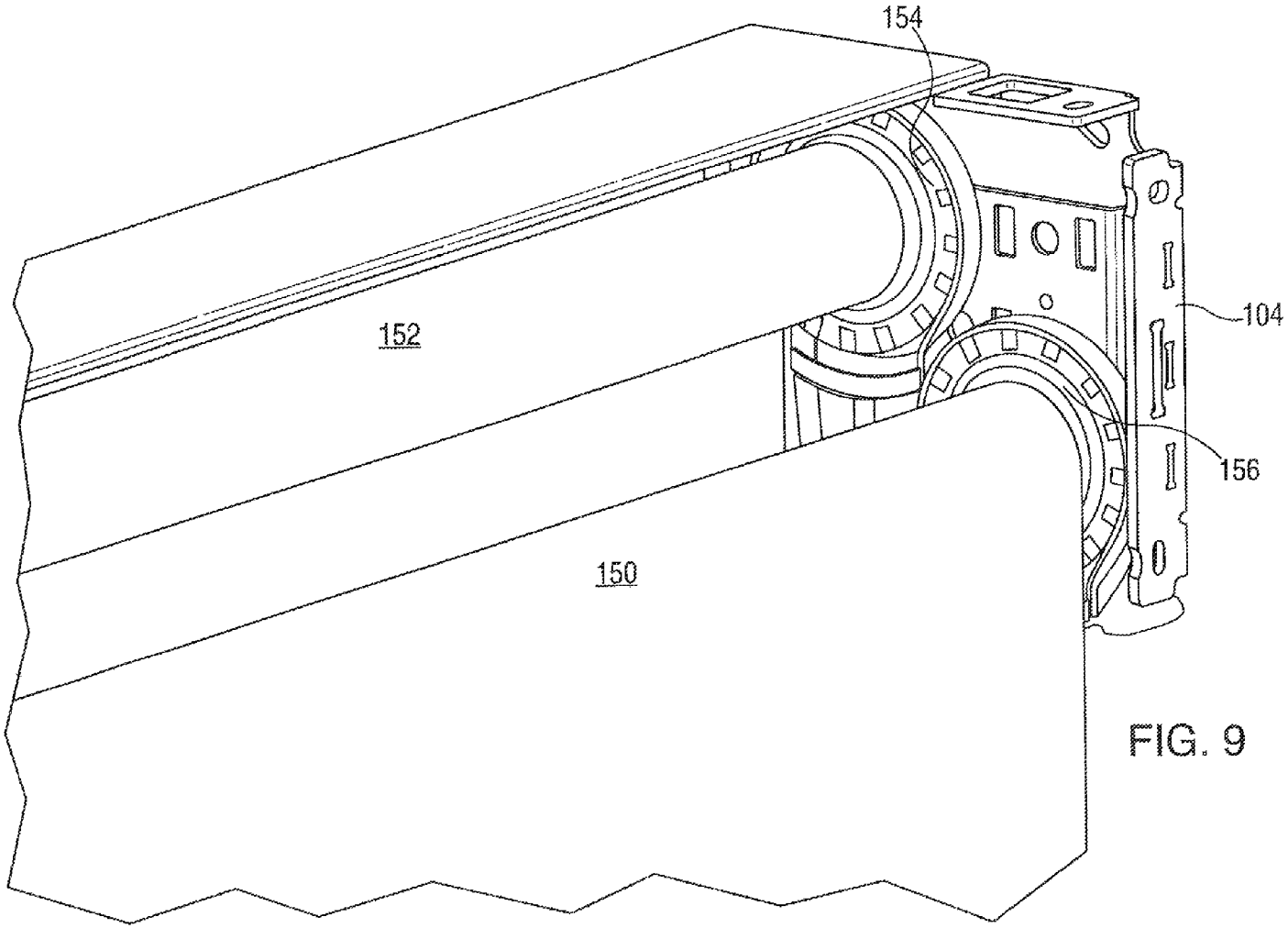
FIG. 9 shows an orthogonal view of the invention configured to receive and support two window dressings attached to a single bracket.
Figure 10:
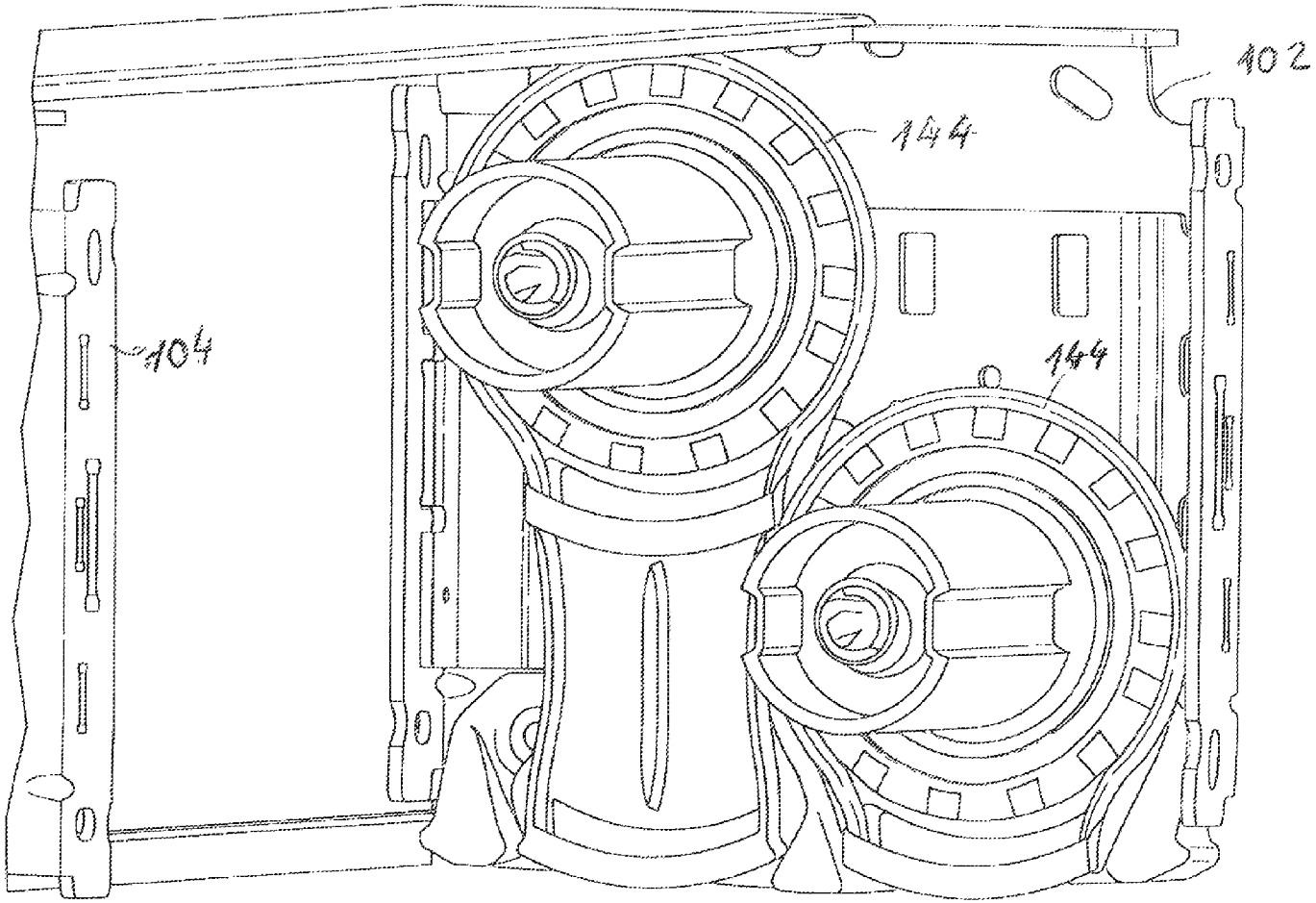
FIG. 10 shows an orthogonal view of the some of the components of the window dressing of FIG. 9.
Figure 11:
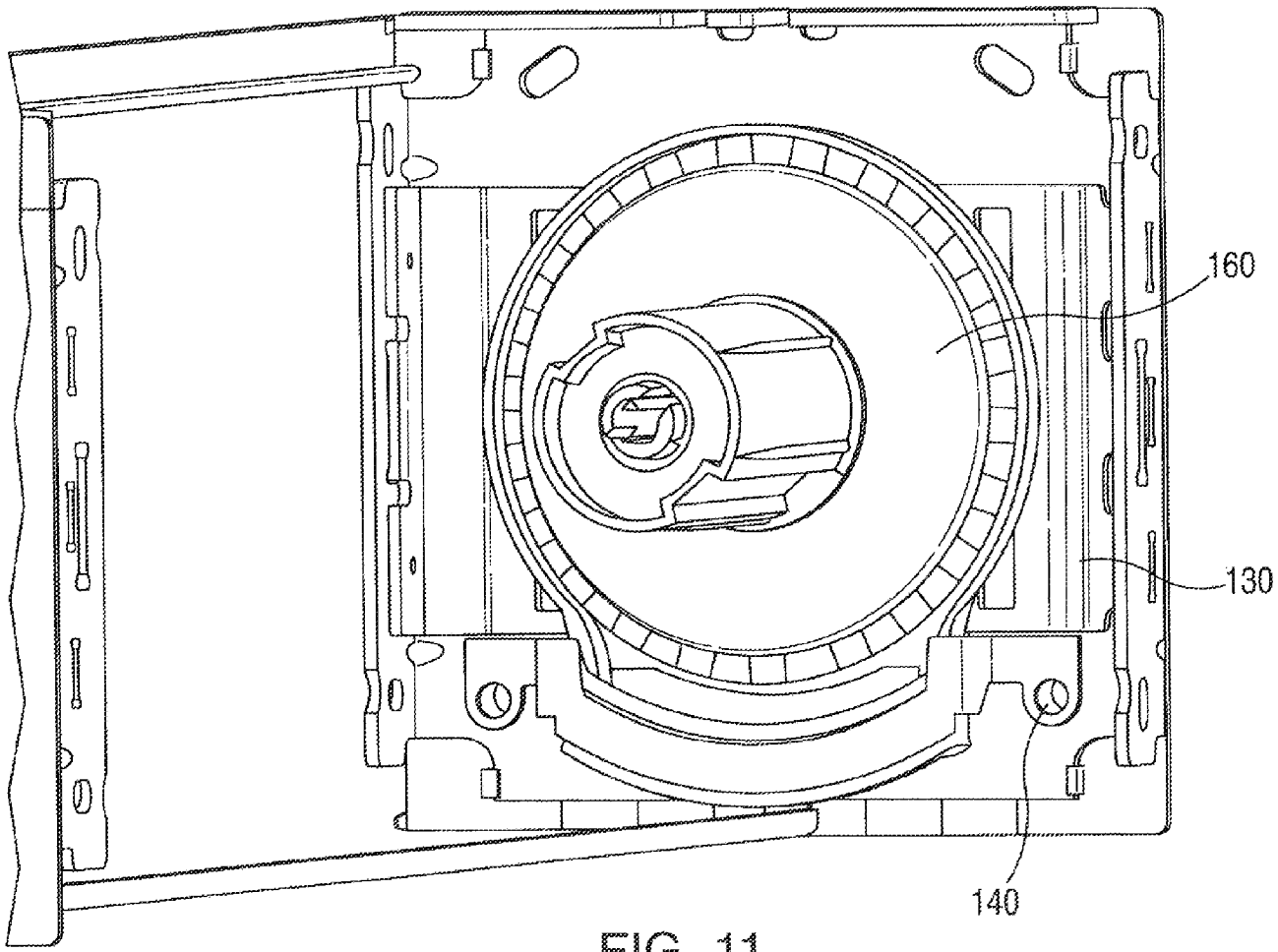
FIG. 11 shows an orthogonal view of the invention configured to receive and support a window dressing having a large diameter.

FIGS. 9 and 10 show configuration in which two parallel window shades 150, 152 with respective clutches 154, 156 are mounted on the same bracket 104 and plate 230. Each of the shades can be operated on its own and can be replaced independently FIG. 11 shows bracket 104, plate 230 and adapter 140 supporting a clutch 160 for receiving a window dressing having a relatively large diameter.

Figure 12:
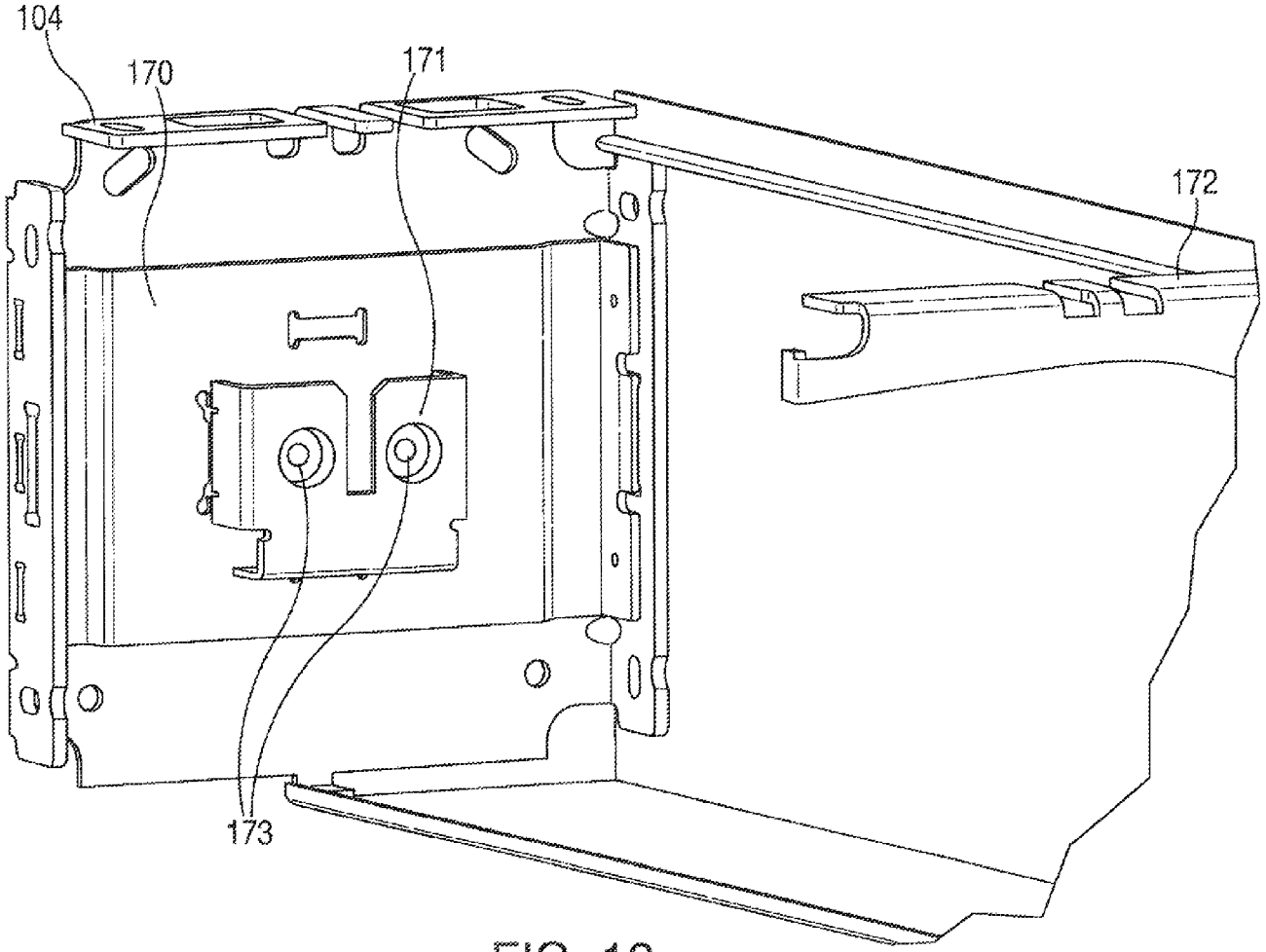
FIG. 12 shows an orthogonal view of the invention configured with an adapter plate shaped to receive and support a motor-driven a window dressing.

FIG. 12 shows bracket 104 with a plate 170 and an adapter 171. Adapter 171 has two lateral horizontal pins 173 sized and shaped to receive and support the ends of a known motorized window shade (not shown). for supporting the pin end of a motorized window shade (not shown). In this figure, an intermediate support 172 is also shown that may be mounted on the wall, a window well, etc., and then couple to the fascia of the bracket system. This intermediate bracket is necessary for very long window dressings that may be too heavy to be supported by only two brackets and may sag in the middle.

Figure 13:
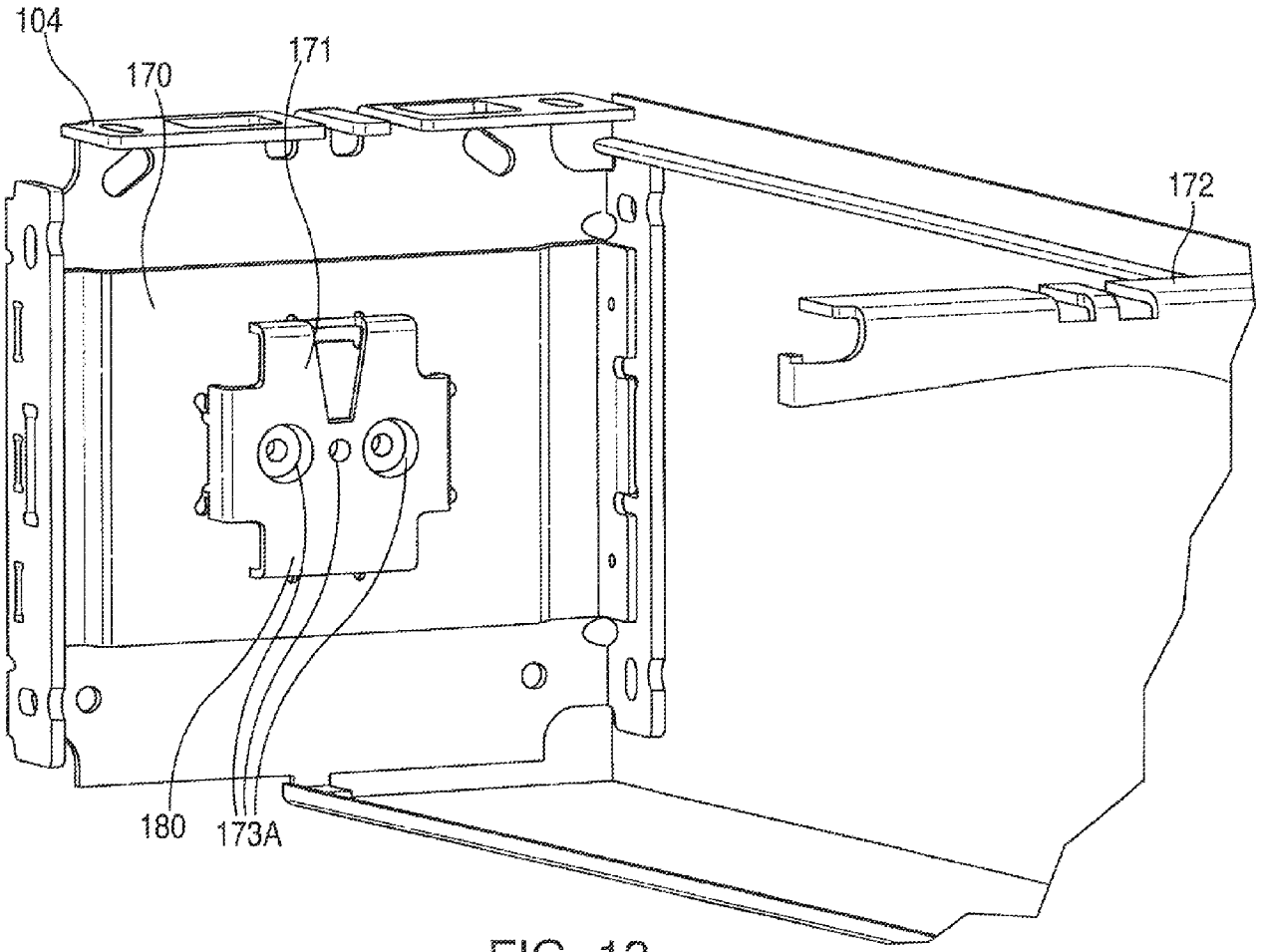
FIG. 13 shows an orthogonal view of the invention configured with an adapter having three holes.

FIG. 13 shows a bracket 104 with plate 170 and adapter 178 having three holes 173A aligned horizontally. This adapted is useful for supporting another line of known window dressings.

Figure 14:
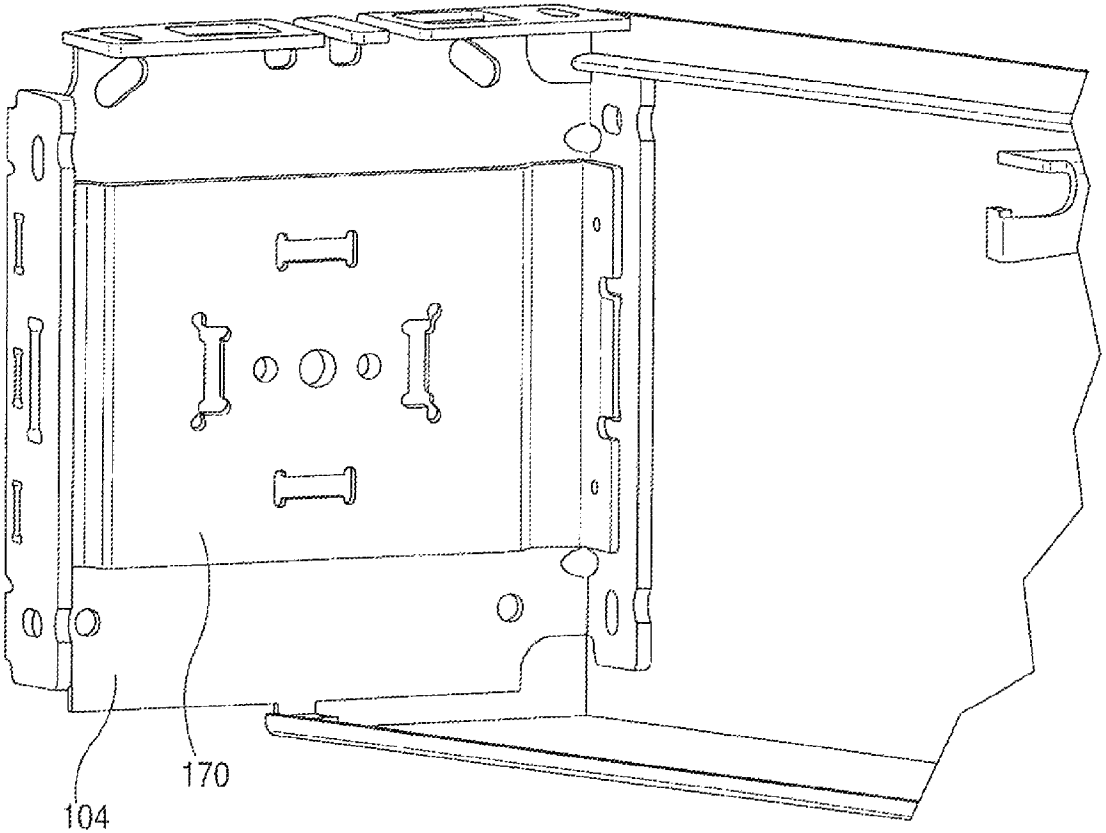
FIG. 14 shows an alternate embodiment of the bracket having a plate three holes in a row.

FIG. 14 shows details of the plate 170 used in FIGS. 12 and 13.

Figure 15:
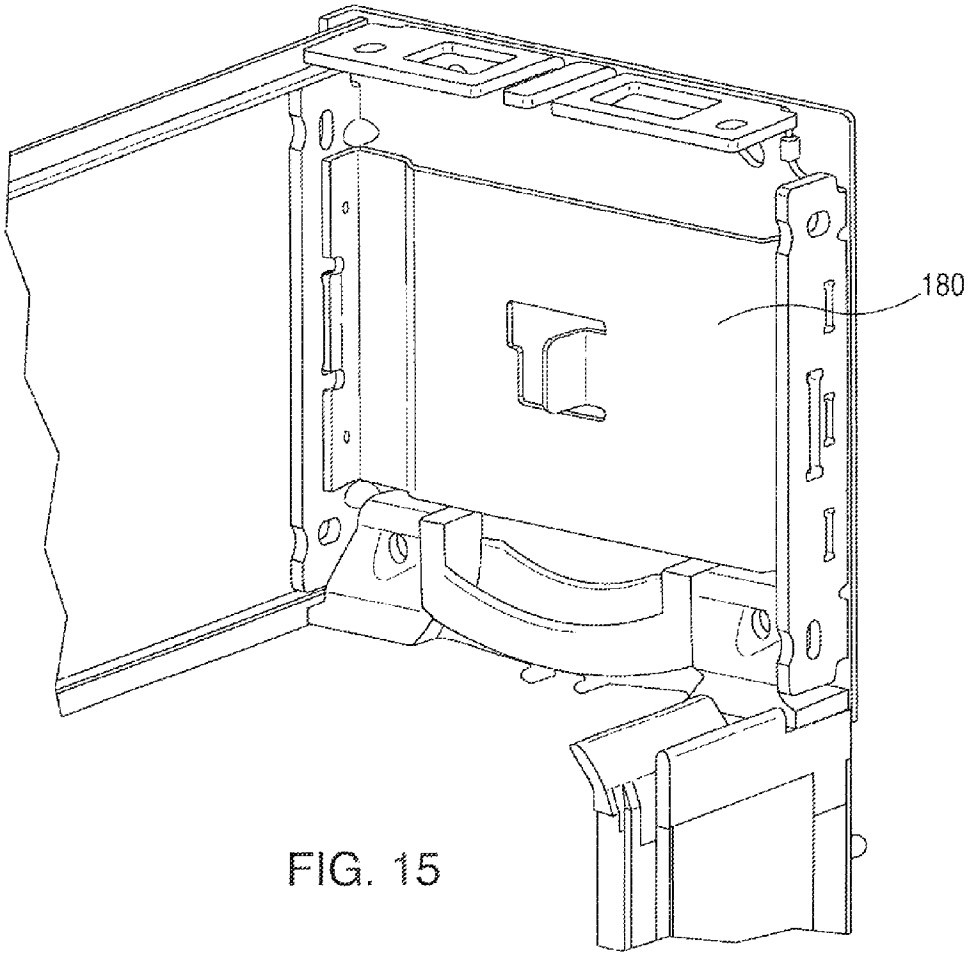
FIG. 15 shows an alternate embodiment of the bracket receiving a clutch plate.

FIG. 15 shows details of a plate 180 for a different kind of clutch.

Figure 16:
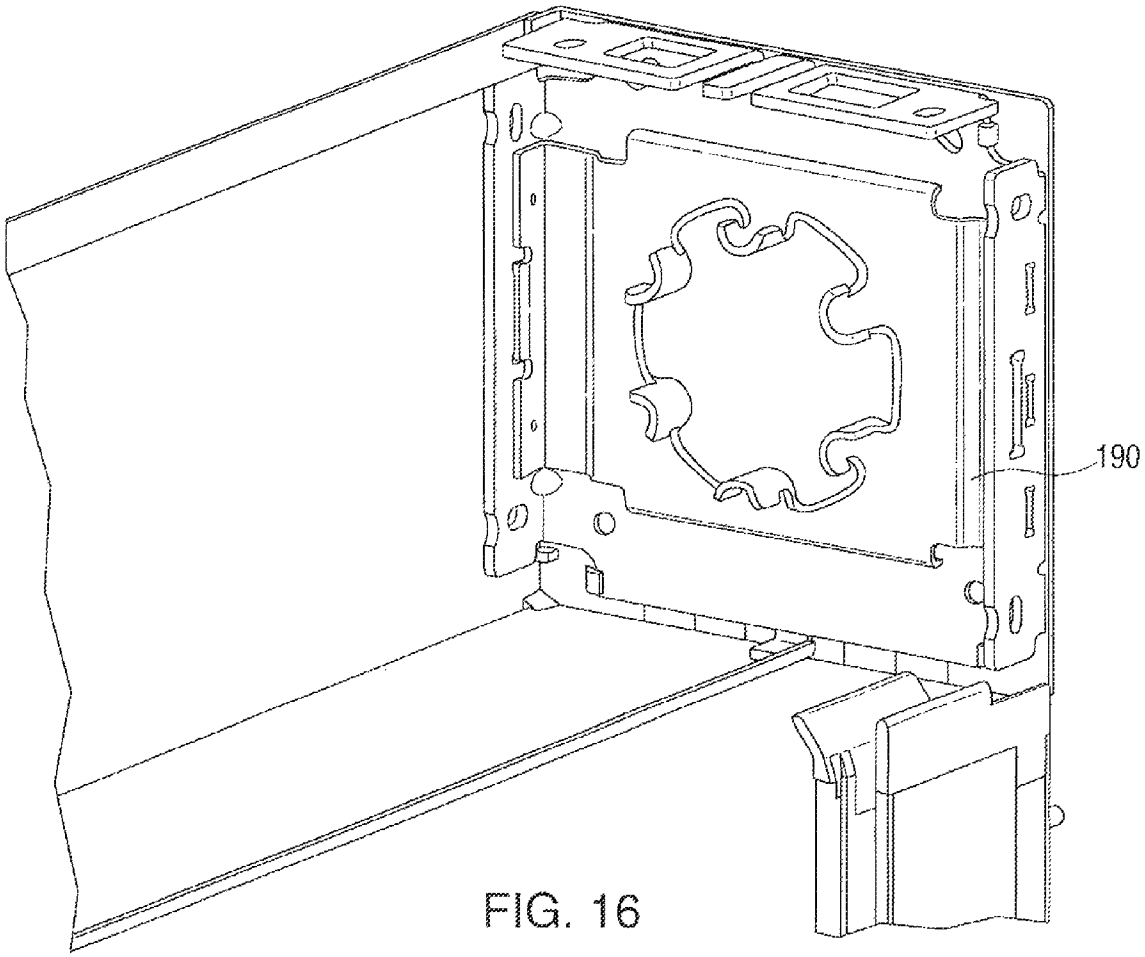
FIG. 16 shows an alternate embodiment of the bracket receiving a plate adapted to receive a motorized window shade.

FIG. 16 shows a bracket 104 with a plate 180 for supporting a SOMFY ST-50 motor.

Numerous modifications may be made to the invention without departing from its scope as defined in the appended claims;

The invention claimed is:

1. A bracket system for mounting a window dressing on an architectural surface, the window dressing having an elongated body terminating with a first and a second end, said bracket system comprising:

a first and a second bracket arranged and constructed to be mounted on the architectural surface, each bracket having a base that is oriented substantially vertically when mounted, and first and second side panels, each side panel being attached to said base, said brackets being oriented when mounted on the architectural surface with their bases parallel to each other; and a plate sized and shaped for attachment to one of said brackets between said first and second side panels and arranged to engage and support one of the ends when said plate is attached to said one of said brackets;

wherein each said first and second side panels includes a respective first aperture and said plate includes a flat surface parallel to said base when said plate is attached to one of said brackets, a first attachment member extending from said flat surface and defining an interference fit with the first aperture of said first side panel and a second attachment member extending from said flat surface and defining another interference fit with the first aperture of said second side panel.

2. The bracket system of claim 1 wherein said plate includes a flat portion essentially parallel to said base when said plate is attached to said one of said brackets, said flat portion including a plurality of plate apertures arranged to engage said one of said ends.

3. A bracket system for mounting a window dressing on an architectural surface, the window dressing having an elongated body terminating with a first and a second end, said bracket system comprising:

a first and a second bracket arranged and constructed to be mounted on the architectural surface, said brackets being identical, each bracket having a base and two side panels, each side panel having a respective side panel aperture, each side panel being attached to said base, said brackets being oriented when mounted on the architectural surface with their bases disposed vertically and in parallel to each other; and first and second plates having a first and a second plate aperture, with said first plate being arranged to engage and support the first end via said first plate aperture and said second plate being arranged to support said second end via said second plate aperture, when said plates are attached to said brackets;

wherein each said plate includes a flat surface, a first attachment member extending from said flat surface and defining an interference fit with the first side panel aperture of one of said side panels, and a second attachment member extending from said flat surface and defining another interference fit with the side panel aperture of the other side panel.

4. The bracket system of claim 2 wherein the window dressing is one of a first and a second type, with the window dressing of a first type having a first style end, and the window dressing of the second type having a second style end, and wherein said plate includes a first plate aperture engaging the end of the first type, and a second plate aperture engaging the end of the second type.

5. The bracket system of claim 1 wherein said first attachment member extends partially into said first aperture.

6. The bracket system of claim 1 further comprising an adapter attached to said plate, said adapter being sized and shaped to support one of said ends of the window dressing.

7. The bracket system of claim 1 wherein said second panel aperture is formed with a flat sidewall extending inwardly to selectively engage said second attachment member.

8. A bracket system for supporting an end of one of a plurality of window dressings, the ends of the said window dressings having different configurations, said system comprising:

a bracket having a base with a flat shape, said bracket being arranged for mounting on an architectural surface with said base being oriented vertically and perpendicularly to a longitudinal axis of the one of a plurality of window dressings; and a plate having a flat section with a plurality of openings, each opening being adapted to receive the end of one of said window dressings and to engage the end to support the window dressing on the architectural surface, said plate being attached to the bracket with said flat section being disposed in parallel with said base;

wherein said bracket includes first and second side panels with respective side panel apertures and said plate includes a first attachment member extending from said flat section and forming a first interference fit with the side panel aperture of said first side panel, and a second attachment member extending from said flat section and forming a second interference fit with the side panel aperture of said second side panel.

9. The bracket system of claim 8 further comprising an adapter selectively attached to said plate, said adapter being configured to engage a window dressing end having a configuration that does not fit into the plate.

* * * * *